US005809587A

United States Patent [19]

Fleischer

[11] Patent Number: 5,809,587

[45] Date of Patent: Sep. 22, 1998

[54] SAFETY DEVICE FOR A SUCTION OUTLET

[75] Inventor: Gene S. Fleischer, New City, N.Y.

[73] Assignee: H-Tech, Inc., Wilmington, Del.

[21] Appl. No.: 810,545

[22] Filed: Mar. 3, 1997

Related U.S. Application Data

[60] Provisional application No. 60/021,451 Jul. 10, 1996.

[51] Int. Cl. [6] ..... E04H 4/06

[52] U.S. Cl. ..... 4/504; 4/507; 4/693; 4/287; 137/585

[58] Field of Search ..... 4/490, 504, 507, 4/509, 287, 653, 693; 137/585, 586

[56] References Cited

U.S. PATENT DOCUMENTS

| | | | |
|---|---|---|---|
| 1,442,171 | 1/1923 | Murphy | 4/507 |
| 1,833,150 | 11/1931 | Beechlyn et al. | 137/585 |
| 3,306,448 | 2/1967 | Baker | 4/509 X |
| 3,940,807 | 3/1976 | Baker et al. | 4/490 |
| 4,115,878 | 9/1978 | Johnson et al. | 4/492 |
| 4,817,991 | 4/1989 | Frentzel et al. | 4/507 X |
| 5,167,041 | 12/1992 | Burkitt, III | 4/509 X |
| 5,341,523 | 8/1994 | Barnes | 4/507 |
| 5,347,664 | 9/1994 | Hamza et al. | 4/509 |
| 5,499,406 | 3/1996 | Chalberg et al. | 4/504 |

*Primary Examiner*—Robert M. Fetsuga
*Attorney, Agent, or Firm*—Selitto & Associates

[57] ABSTRACT

A safety device for use in a suction outlet assembly of a swimming pool, whirlpool, spa or the like is disclosed. More particularly, the outlet assembly has an opening therein in communication with a pump adapted to create sufficient suction for causing fluid flow through the outlet assembly and a cover mounted over the opening without substantially obstructing fluid flow therethrough. The safety device includes an obstructing mechanism for obstructing the opening when the cover is not properly positioned or affixed to the outlet assembly, whereby fluid flow through the outlet assembly is substantially prevented even if the pump is in operation.

34 Claims, 7 Drawing Sheets

FIG. 6A
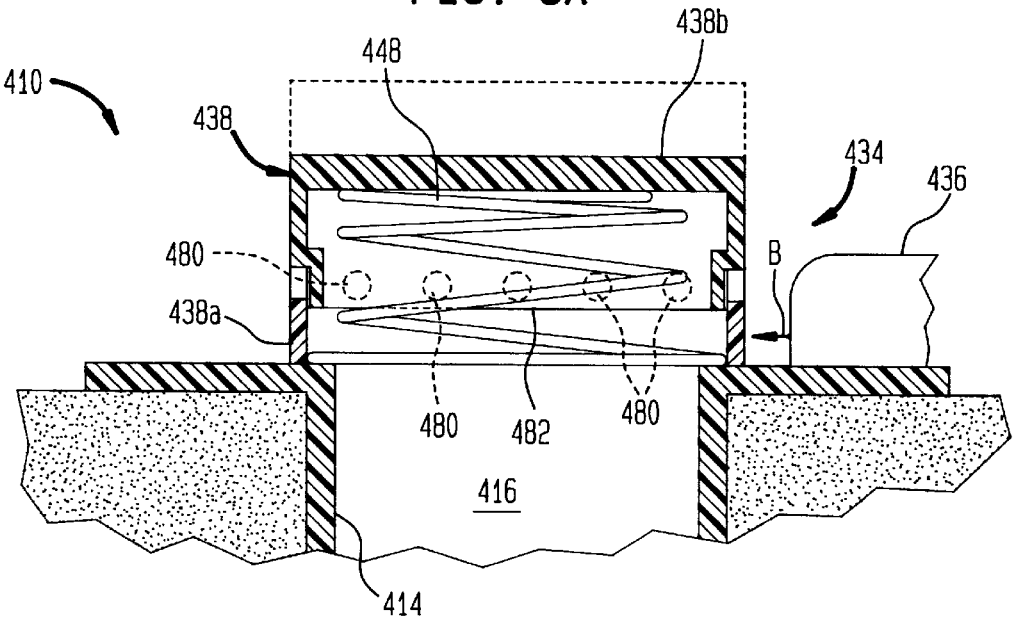
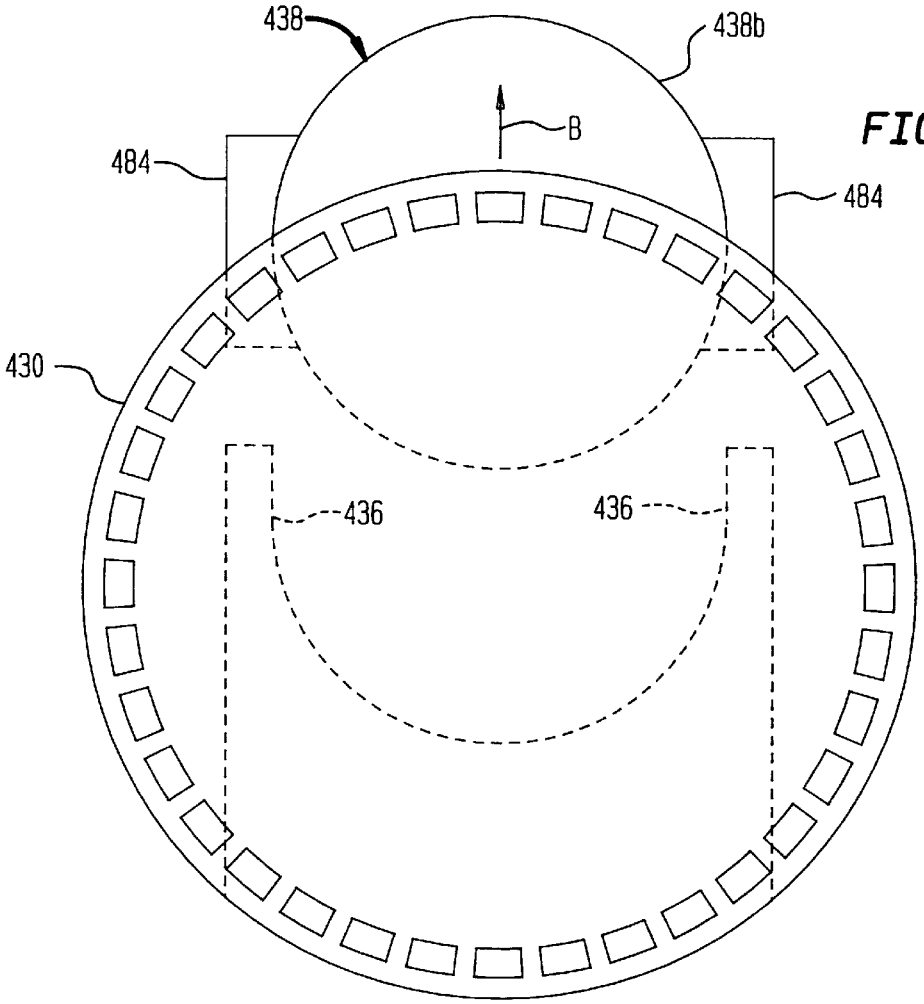
FIG. 6B

SAFETY DEVICE FOR A SUCTION OUTLET

CROSS REFERENCE TO RELATED APPLICATIONS

This is a §111(a) application relating to U.S. application Ser. No. 60/021,451 filed Jul. 10, 1996.

FIELD OF THE INVENTION

The present invention relates to safety devices for use in connection with suction outlets, and, more particularly, to safety devices equipped with a valve mechanism specifically adapted for use in connection with drain outlets of swimming pools, spas, whirlpools or the like.

BACKGROUND OF THE INVENTION

A conventional water circulation system for a swimming pool is equipped with a suction pump and a drain outlet formed in the floor of the pool and connected to the suction side of the pump. During the operation of the circulation system, the water is drawn into the circulation system through the drain outlet by the suction applied by the pump. For user safety purposes, the drain outlet is typically covered with a cover to prevent large objects, such as human body parts, from being sucked into the drain outlet. However, if the cover is accidentally removed from the drain outlet, the outlet becomes exposed, and, as a result, there is a risk that human body parts are accidentally drawn into the outlet during the operation of the circulation system (i.e., the pump). That is, there is a risk of injury to swimming pool users.

Various devices have been developed for use in connection with outlets of swimming pools, spas, hot tubs or the like. For instance, U.S. Pat. No. 1,442,171 relates to a surface drainage outlet for a swimming pool. More particularly, the drainage outlet includes an outer chamber in communication with the pool and an inner chamber. A drain pipe connects the inner chamber to a bottom pool outlet. A valve, which is manually controlled by manipulating an external handwheel, is mounted on the drain pipe for controlling water flow therethrough. Because, the valve is manually controlled, the valve is not adapted to perform any type of safety function.

U.S. Pat. No. 3,306,448 discloses an automatic skim tank having an opening communicating with a suction pipe which is connected to a pump. A buoyant ball closure is positioned in the tank such that when the water level falls below a predetermined level, the closure obstructs the opening, thereby preventing air flow to the pump. While this device is designed to prevent damage to the pump, it is not designed for user safety purposes. In addition, because the closure is responsive to the water level, it is not adapted to be responsive to the condition or position of an associated drain cover.

U.S. Pat. No. 5,167,041 and U.S. Pat. No. 5,347,664 relate to a suction fitting device connected to a suction pump. More particularly the suction fitting device is equipped with a pressure sensor line connected to a water level sensor. When water flow through the suction fitting device is blocked, for instance, by hair, water is drawn out of the pressure line, permitting detection of the blockage by the water level sensor which turns off the pump. While this device is designed to perform a user safety function, it is not adapted to perform such a function in response to the position or condition of an associated cover.

U.S. Pat. No. 5,499,406 discloses a safety suction assembly for use in whirlpools or the like. The suction assembly is equipped with an air induction tube adapted to induct air into a recirculating water pump to cause the pump to cease pumping operation when the assembly's front face is blocked by, for instance, the hair of a user. While this assembly is designed to perform a user safety function, it is not adapted to perform such a function in response to the position or condition of an associated cover.

U.S. Pat. No. 4,817,991 discloses a safety fitting for closing a vacuum orifice in a swimming pool. The fitting is provided with a hollow body adapted to be attached to the orifice. The device also includes a spring loaded cap adapted to close and to thereby seal the orifice when an associated vacuum hose is disengaged from the body of the fitting. The cap is provided with a lug sized and shaped so as to engage corrugations of the vacuum hose for inhibiting disengagement of the hose from the body of the fitting. While this fitting is designed for a user safety purpose, the fitting is not adapted to achieve such a purpose in response to the position or condition of an associated cover.

SUMMARY OF THE INVENTION

The present invention relates to a new and improved safety device which overcomes the problems and disadvantages of the prior art discussed above. More particularly, the safety device is adapted for use in a suction outlet assembly of a swimming pool, whirlpool, spa or the like. The outlet assembly has an opening therein in communication with a pump adapted to create sufficient suction for causing fluid flow through the outlet assembly and a cover mounted over the opening without substantially obstructing fluid flow therethrough. The safety device includes an obstructing mechanism for obstructing the opening when the cover is not properly positioned or affixed to the outlet assembly, whereby fluid flow through the outlet assembly is substantially prevented even if the pump is in operation. More particularly, the obstructing mechanism is provided with a valve movable between an open position, in which the valve permits fluid flow through the opening, and a closed position, in which the valve inhibits fluid flow through the opening. The safety device also includes a positioning mechanism for positioning the valve in the open position when the cover is properly positioned or affixed to the outlet assembly, as well as an urging mechanism for urging the valve towards its closed position.

In accordance with one embodiment of the present invention, the valve is pivotally mounted within the opening adjacent an outlet of the outlet assembly. In addition, the positioning mechanism is provided with a plunger positioned between the cover and the valve for pivoting the valve to its open position when the cover is properly affixed to the outlet assembly.

In accordance with another embodiment of the present invention, the valve is pivotally mounted from the outlet assembly adjacent the inlet of same. Moreover, the positioning mechanism includes an extension depending from the cover and adapted to engage the valve for pivoting the valve to the open position when the cover is properly affixed to the outlet assembly. Alternatively, the positioning mechanism is provided with a pinion, which is mounted on the valve, and a rack extending from the cover and having a plurality of teeth which are sized and shaped so as to mate with the pinion to thereby pivot the valve to the open position when the cover is properly affixed to the outlet assembly.

Yet another embodiment involves utilizing a lower valve member, which is immovably mounted on the outlet assembly over the opening, and an upper valve member movably mounted on the lower member so as to move between an upper position, in which the upper member cooperates with the lower member to permit fluid flow through the valve and hence through the outlet assembly, and a lower position, in which the upper member cooperates with the lower member to inhibit fluid flow through the valve and hence through the outlet assembly. The positioning mechanism is provided with a cam extending from the cover and adapted to engage the upper member for positioning same in the upper position when the cover is properly affixed to the outlet assembly.

In accordance with a further embodiment of the present invention, the valve is rotatably mounted on the outlet assembly. The positioning mechanism is provided with a projection, which extends from the valve, and a cam depending from the cover and adapted to engage the projection for rotating the valve to the open position as the cover is applied to the outlet assembly.

BRIEF DESCRIPTION OF THE DRAWINGS

For a more complete understanding of the present invention, reference is made to the following detailed description of various exemplary embodiments considered in conjunction with the accompanying drawings, in which:

FIG. 6A is a cross-sectional side view of a drain equipped with a safety device constructed in accordance with a fifth embodiment of the present invention;

FIG. 6B is a top plan view of the drain illustrated in FIG. 6A during the installation of a drain cover to the drain;

DETAILED DESCRIPTION OF THE EXEMPLARY EMBODIMENTS

Although the present invention can be used in conjunction with any type of suction outlet, it is particularly suitable for use in connection with a drain of a swimming pool. Accordingly, the present invention will be described hereinafter in connection with such a drain. It should be understood, however, that the following description is only meant to be illustrative of the present invention and is not meant to limit the scope of the present invention, which has applicability to other types of suction outlets, such as outlets of whirlpools and spas.

Figure 1:
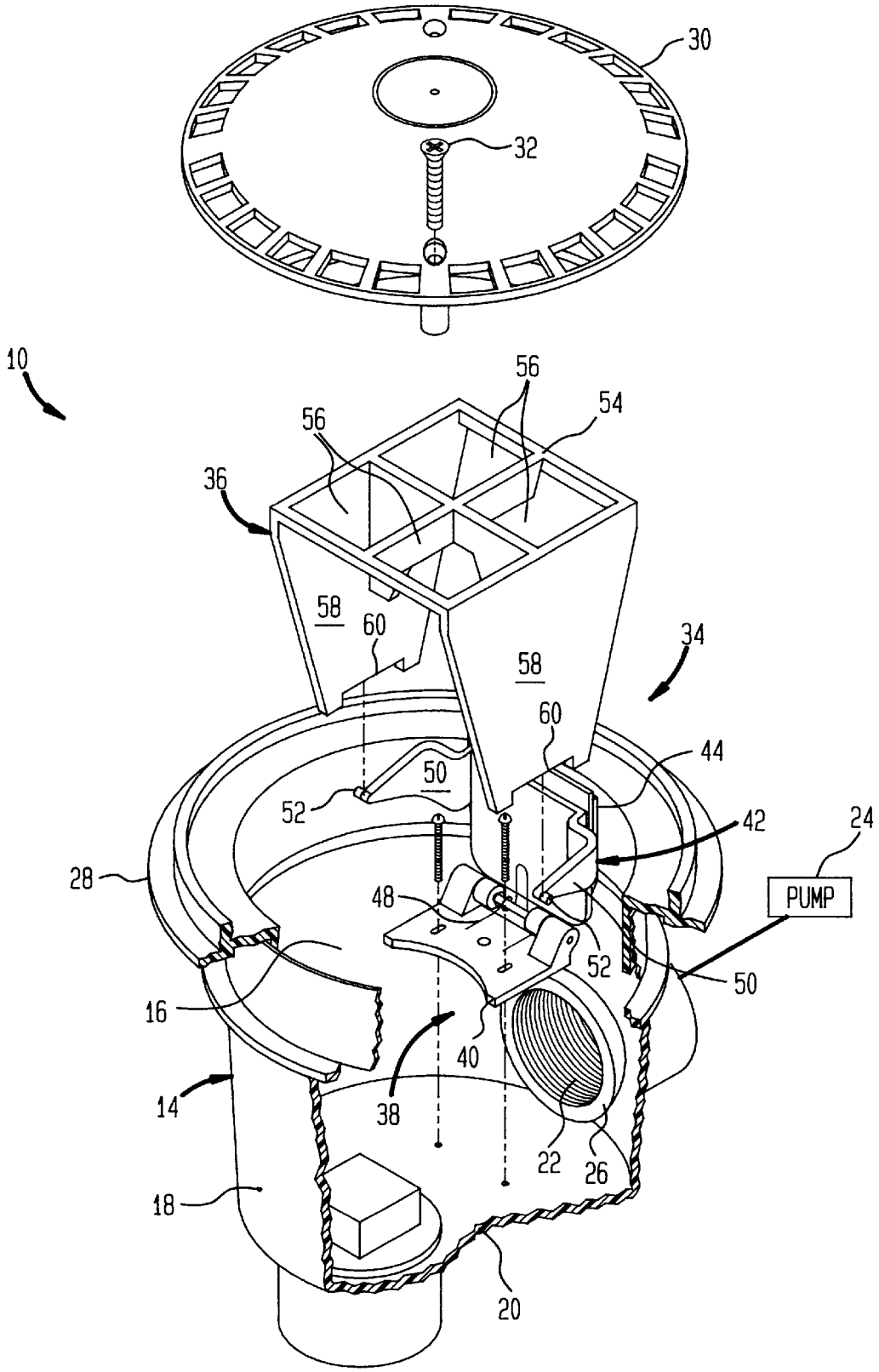
FIG. 1 is a cutaway exploded perspective view of a drain equipped with a safety device constructed in accordance with a first embodiment of the present invention.
Figure 2B:
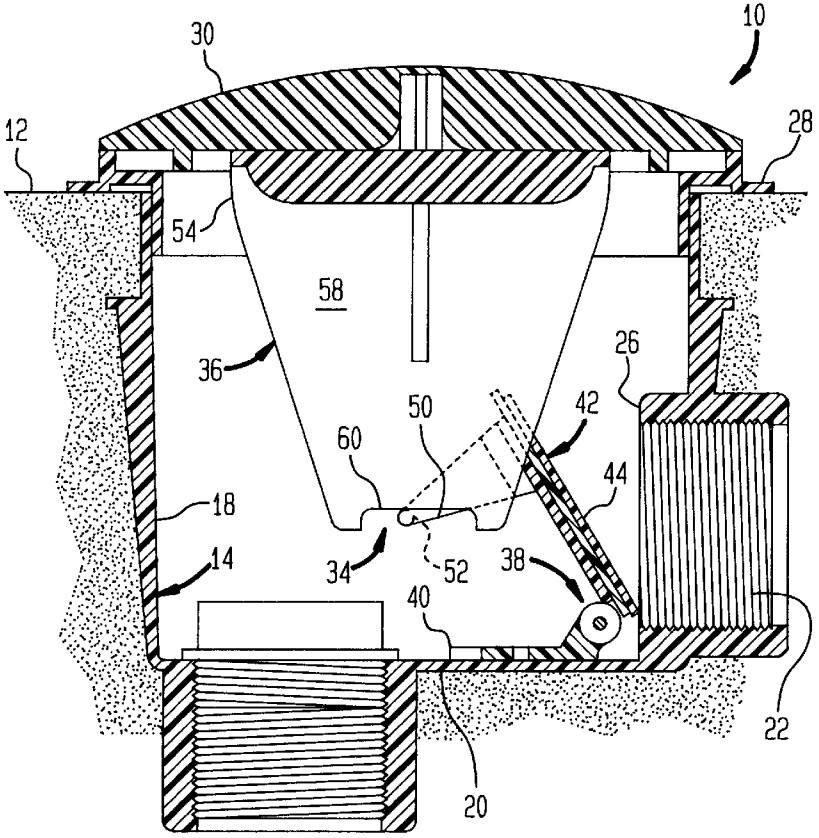
FIG. 2B is a view similar to FIG. 2A, except that the drain cover is properly applied to the drain.
Figure 2A:
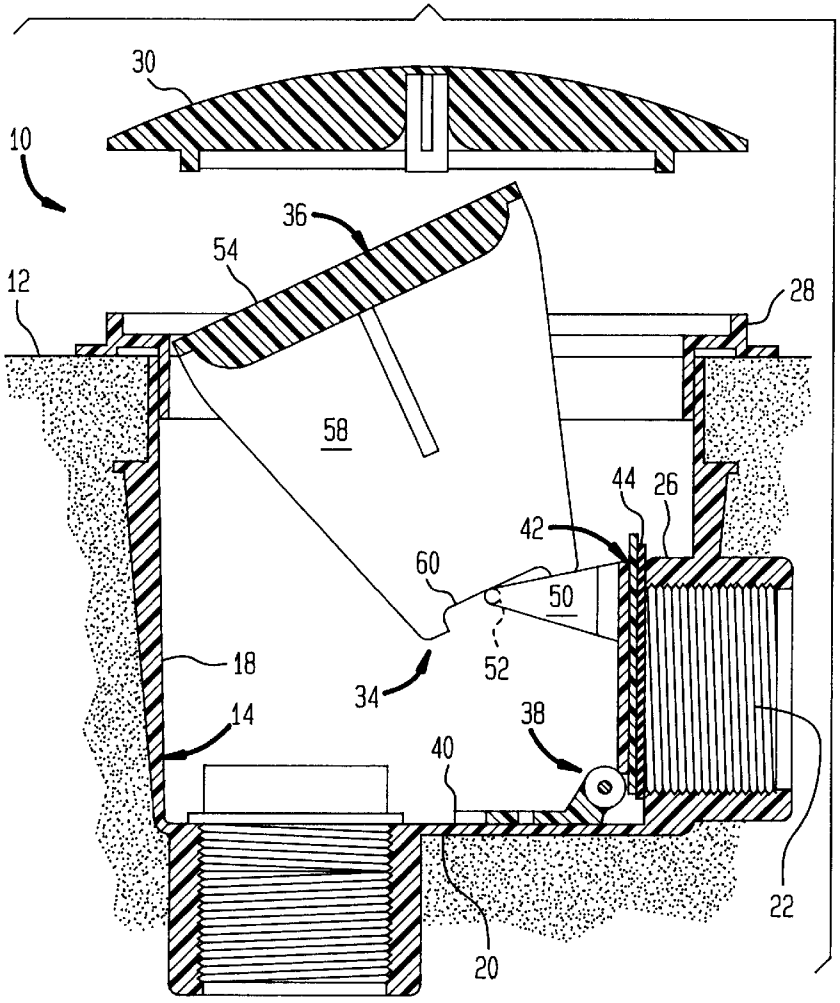
FIG. 2A is a cross-sectional side view of the drain shown in FIG. 1, an associated drain cover being detached from the drain.

FIGS. 1–2B illustrate a suction drain 10 mounted in a floor of a swimming pool 12. The drain 10 includes a cup-shaped drain body 14 having an opening 16 formed in the drain body 14 and communicating with the swimming pool 12. The drain body 14 also includes a side wall 18 and a bottom wall 20. An outlet 22 is formed in the side wall 18 of the drain body 14 and is coupled to a suction pipe connected to a pump 24. A valve seat 26 is provided around the outlet 22 for purposes to be discussed hereinafter. The drain 10 also includes a retaining ring 28 permanently attached to the floor of the swimming pool 12 and the drain body 14 in a fluid-tight manner so as to seal a gap formed between same (see FIGS. 2A and 2B). Moreover, the drain 10 is provided with an anti-vortex cover 30 adapted to be removably secured to the drain body 14 by a pair of screws 32 (only one of which is shown in FIG. 1) for covering the opening 16 without substantially obstructing fluid flow through the drain body 14.

Still referring to FIGS. 1–2B, the drain 10 is provided with a safety device 34 equipped with a plunger or positioning member 36 and a flapper valve 38. More particularly, the valve 38 includes a base 40, which is removably attached to the bottom wall 20 of the drain body 14 adjacent the outlet 22 using a pair of screws, and a valve member 42, which has a sealing surface 44 on one side thereof. The sealing surface 44 is preferably made from any conventional material adapted to perform a sealing function, such as rubber. The valve member 42 is hinged to the base 40 and is therefore pivotable between an open position, in which the sealing surface 44 of the valve member 42 is out of contact with the valve seat 26 of the drain body 14 (see FIG. 2B), and a closed position, in which the sealing surface 44 of the valve member 42 is in contact with the valve seat 26 (see FIG. 2A). For urging the valve member 42 toward the closed position, a spring 48 is mounted on the valve 38. In addition, a pair of arms 50 extends from an opposite side of the valve member 42 away from the sealing surface 44, while a pair of pegs 52 projects from the arms 50 in a direction transverse to the axis of the arms 50 for purposes to be discussed hereinafter.

The plunger 36 includes a head 54, which is equipped with a plurality of holes 56 sized and shaped so as not to substantially obstruct the opening 16 and therefore water flow through the drain 10, and a pair of legs 58 depending from the head 54. The legs 58 are spaced apart from each other such that the distance between them is slightly greater than the distance between the arms 50 of the valve 38. The free end of each of the legs 58 (i.e., the end opposite the head 54) is provided with a track 60 sized and shaped so as to engage a corresponding one of the pegs 52 for a purpose to be described hereinafter.

With reference to FIGS. 2A and 2B, when the cover 30 is not installed to or is removed from the drain 10, the valve member 42 is in the closed position due to the force applied to same by the spring 48 (see FIG. 2A). With the pump 24 turned off, the cover 30 and the plunger 36 are installed to the drain 10. More particularly, the tracks 60 of the plunger 36 are positioned on the pegs 52, and, with the tracks 60 resting on the pegs 52, the cover 30 is applied to the drain 10. During the application of the cover 30 to the drain 10, the plunger 36 is forced to move downwardly towards the bottom wall 20 of the drain body 14, causing the pegs 52 to move along the tracks 60 away from the valve seat 26 and thereby causing the valve member 42 to pivot from its closed position to its open position. When the cover 30 is properly applied to the retaining ring 28, the screws 32 are applied to the retaining ring 28 for securing the cover 30 the body 14 to the drain 10. In this manner, the cover 30 keeps the plunger 36 in its down position (i.e., prevents same from moving upwardly), and the valve member 42 is therefore maintained in its open position (see FIG. 2B), allowing water flow through the drain 10 during the operation of the pump 24. If, during the operation of the pump 24, the cover 30 is removed from the drain 10 accidentally or otherwise, the spring 48 of the valve 38 causes the valve member 42 to move from its open position to its closed position (see FIG. 2A), thereby obstructing the outlet 22 and hence the opening 16. When the sealing surface 44 comes in contact with the valve seat 26 of the drain body 14, suction applied by the pump 24 acts upon the sealing surface 44 and causes same to seal the outlet 22 of the drain 10, thereby preventing water flow through the outlet 22. As a result, the suction applied by the pump 24 is prevented from acting upon water in the opening 16 of the drain 10, as well as water in the swimming pool 12 around the drain 10, thereby preventing bodily injuries to users in the vicinity of the drain 10.

It should be appreciated that the safety device 34 provides numerous advantages over the prior art discussed hereinabove. For instance, when the cover 30 is removed, either accidentally or otherwise, from the drain 10 during the operation of the pump 24, because the safety device 34 automatically obstructs the outlet 22 of the drain 10 in response to the removal of the cover 30, the safety device 34 prevents the development of the unsafe condition which has existed in the conventional swimming pool outlets described above. In addition, because the spring 48 constantly urges the plunger 36 upwardly, in the event that the cover 30 is not properly secured to the retaining ring 28 (e.g., the screws 32 are loosely applied to the retaining ring 28), the spring 48 causes the cover 30 to pop up from the drain 10, thereby preventing a potentially unsafe condition from developing. Moreover, because the safety device 34 is adapted to be installed in a conventional drain, such a drain can be retrofitted with same to promote a user-safe condition.

It should be noted that the safety device 34 can have numerous modifications and variations. For instance, the base 40 can be integrally formed with the bottom wall 20 of the drain body 14. In addition, the plunger 36 can be integrally formed with the cover 30 or can include only one leg adapted to engage the valve 38. Moreover, the safety device 34 can be provided with an automatic shut-off mechanism for shutting off the pump 24 when the valve 38 is in the closed position. Alternatively, the pump 24 can be left to operate until it burns out or until it is manually shut off by a user. Further, while it is desirable to completely obstruct the outlet 22 and hence the opening 16 such that water flow through the drain 10 is completely precluded, for the proper operation of the safety device 34, it is only necessary to substantially obstruct the outlet 22 and hence the opening 16 such that water flow through the drain 10 is substantially precluded. Accordingly, as used herein, to "obstruct" shall mean to substantially obstruct.

FIGS. 3–7B depict various embodiments of the present invention. Elements illustrated in FIG. 3, FIG. 4, FIG. 5, FIGS. 6A and 6B and FIG. 7A and 7B which correspond, either identically or substantially, to the elements described above with respect to the embodiment of FIGS. 1–2B have been designated by corresponding reference numerals increased by one hundred, two hundred, three hundred, four hundred and five hundred, respectively. Unless otherwise stated, the embodiments of FIGS. 3–7B are constructed and assembled in the same basic manner as the embodiment of FIGS. 1–2B.

Figure 3:
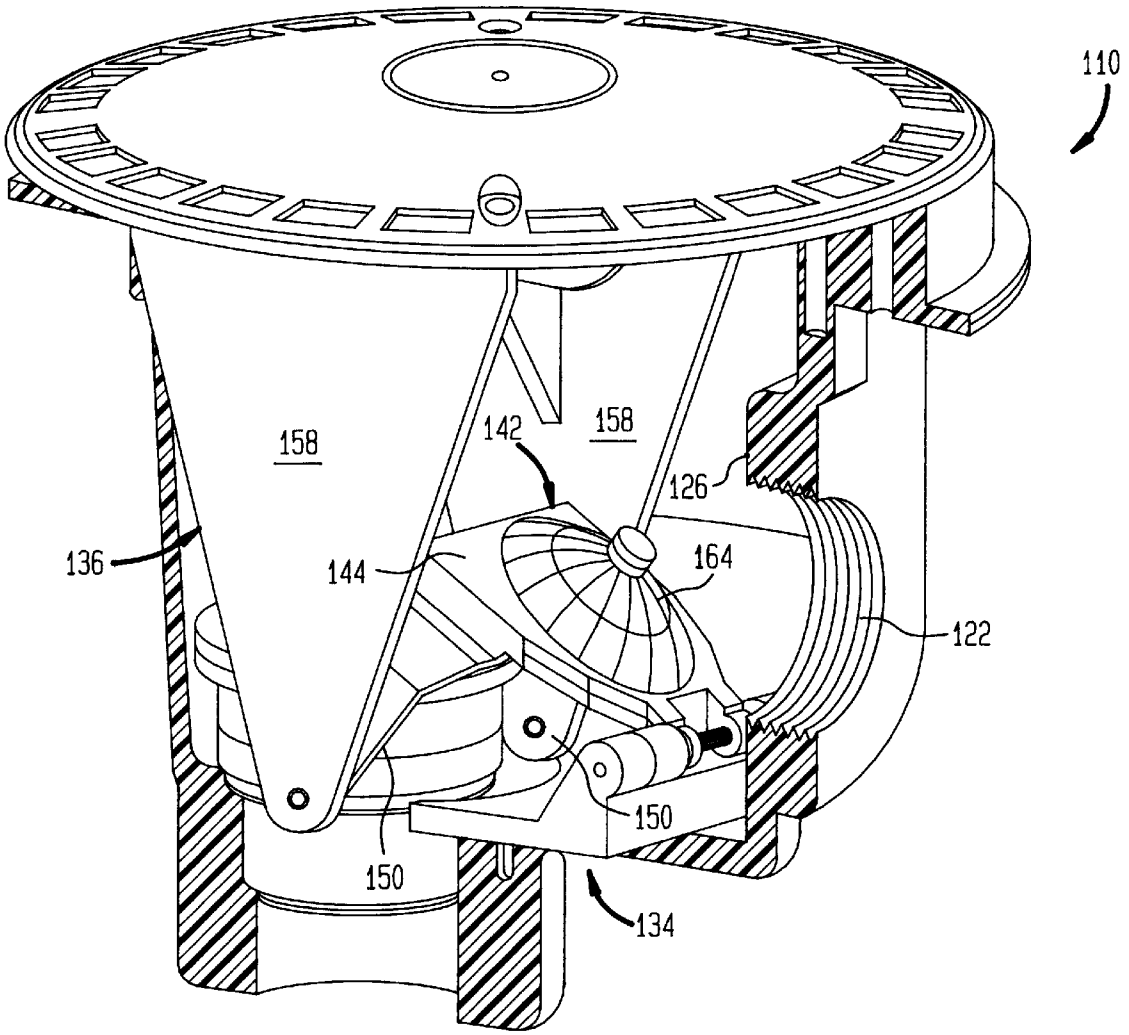
FIG. 3 is a cutaway perspective view of a drain equipped with a safety device constructed in accordance with a second embodiment of the present invention.

FIG. 3 shows a drain 110 which is equipped with a safety device 134 constructed in accordance with a second embodiment of the present invention. The construction and operation of the safety device 134 are identical to those of the safety device 34 illustrated in FIGS. 1–2B, except as follows. A plunger 136 of the safety device 134 is provided with a pair of legs 158 having ends which are rotatably attached to a pair of arms 150 of a valve member 142. In this manner, the tracks 60 and pegs 52 illustrated in FIGS. 1–2B are eliminated, while the proper engagement between the plunger 136 and the valve member 142 is positively ensured. Moreover, a sealing surface 144 of the valve member 142 is provided with a projection 164 for properly positioning the valve member 142 against a valve seat 126 formed around an outlet 122 of the drain 110 when the valve member 142 moves into its closed position.

Figure 4:
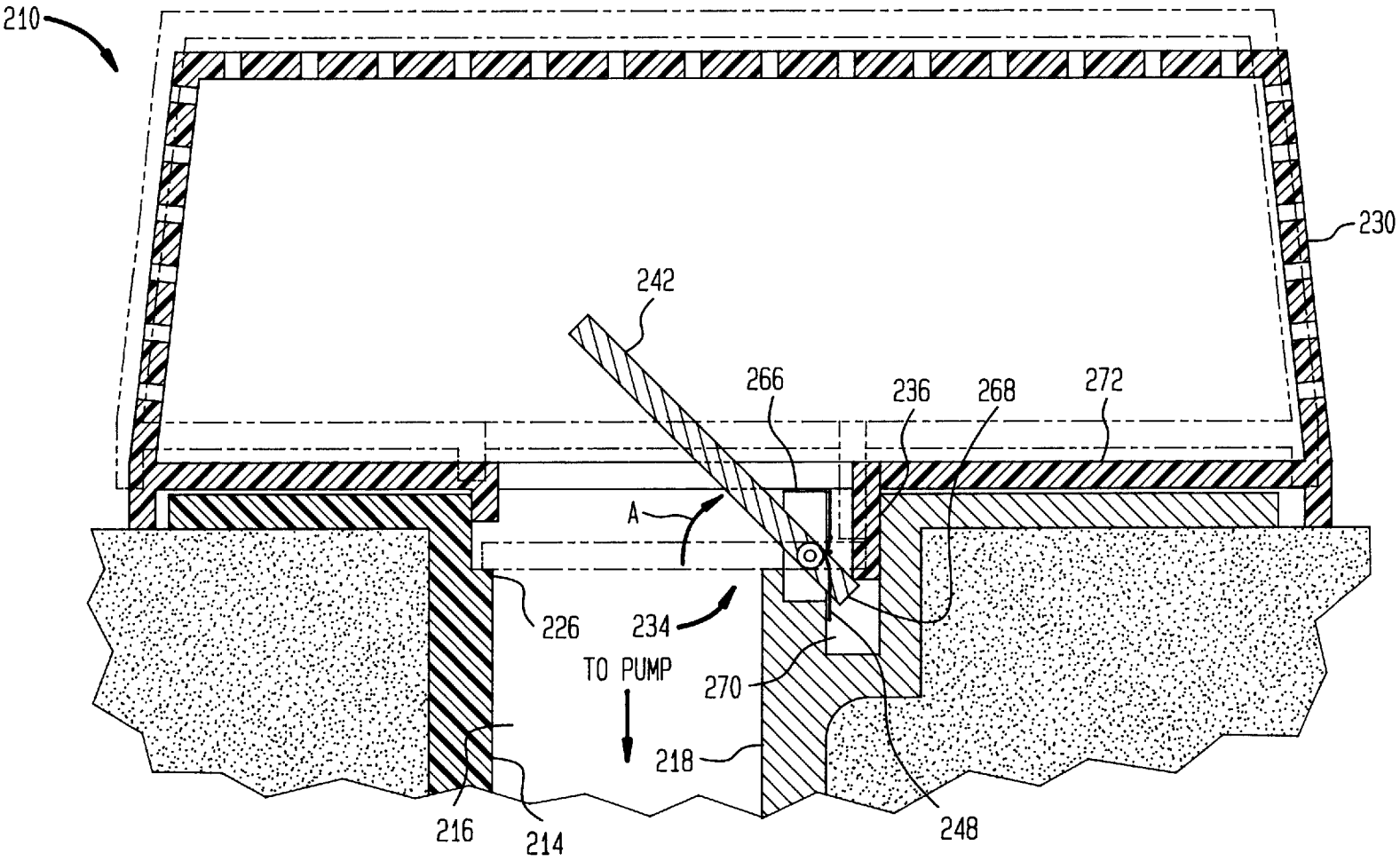
FIG. 4 is a cross-sectional side view of a drain equipped with a safety device constructed in accordance with a third embodiment of the present invention.

FIG. 4 shows a drain 210 equipped with a safety device 234 constructed in accordance with a third embodiment of the present invention. The construction and operation of the safety device 234 are identical to those of the safety device 34 illustrated in FIGS. 1–2B, except as follows. A flapper valve member 242 is pivotally mounted to valve supports 266 (only one of which is shown in FIG. 4) formed in a side wall 218 of a drain body 214 of the drain 210. As a result, the valve member 242 is pivotable between an open position (indicated by the solid line representation of the valve member 242 in FIG. 4), in which the valve member 242 is out of contact with a valve seat 226 formed around an opening (i.e, passageway) 216 of the drain body 214, and a closed position (indicated by the broken line representation of the valve member 242 in FIG. 4), in which the valve member 242 is in contact with the valve seat 226. A torsion spring 248 is provided so as to urge the valve member 242 toward its closed position. Moreover, the valve member 242 has an extension 268 positioned in a slot 270 formed in the side wall 218 of the drain body 214. For user safety purposes, the drain 210 is provided with a cover 230 having a cam 236 which depends from a spider 272 of the cover 230.

Still referring to FIG. 4, to install the cover 230, it is applied to the drain 210 from above (as indicated by the broken line representation of the cover 230 in FIG. 4) and is then secured to the drain 210 using screws (not shown). As the cover 230 is applied to the drain 210, the cam 236 pushes the extension 268 of the valve member 242 downwardly, causing the valve member 242 to pivot towards the open position. In the event that the cover 230 is removed accidentally or otherwise from the drain 210, the spring 248 causes the valve member 242 to pivot towards its closed position, thereby obstructing the opening 216 and therefore the valve's outlet (not shown) connected to an associated pump (not shown).

Figure 5:
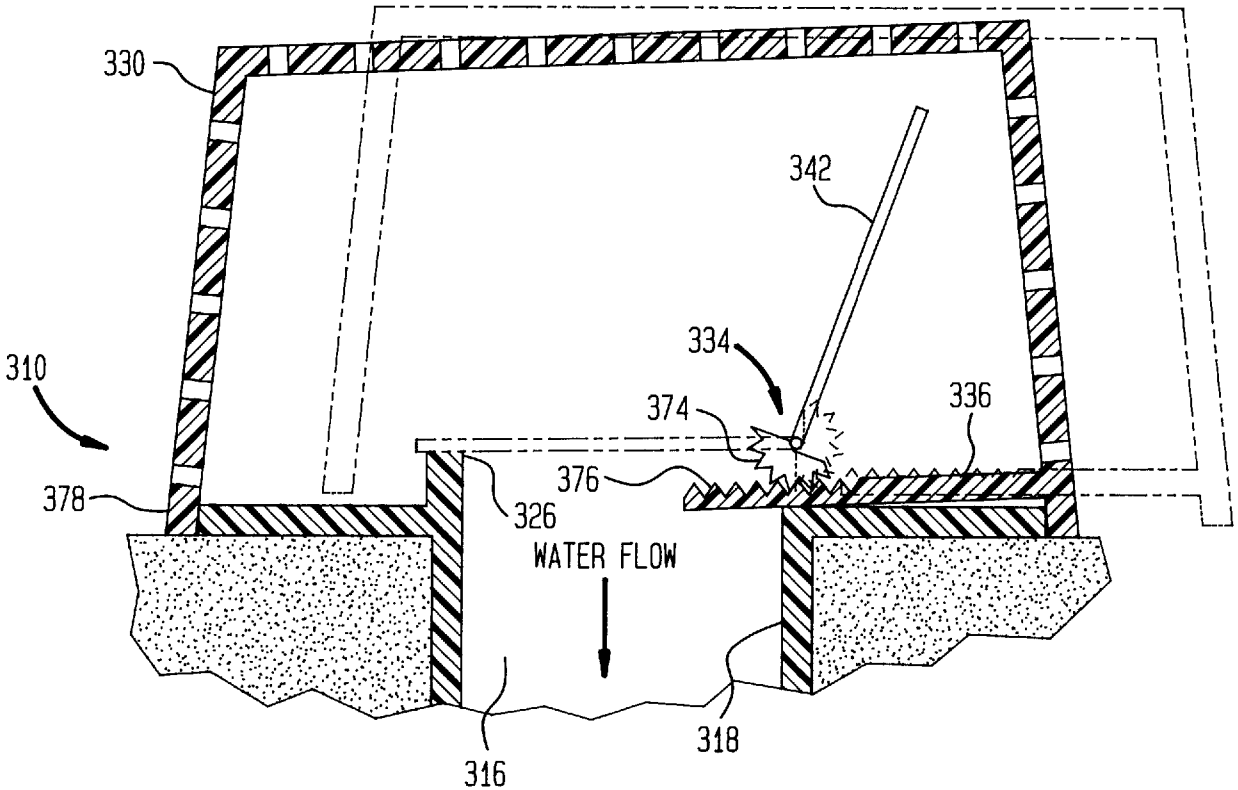
FIG. 5 is a cross-sectional side view of a drain equipped with a safety device constructed in accordance with a fourth embodiment of the present invention.

FIG. 5 shows a drain 310 which is equipped with a safety device 334 constructed in accordance with a fourth embodiment of the present invention. The construction and operation of the safety device 334 are identical to those of the safety device 34 illustrated in FIGS. 1–2B, except as follows. A valve member 342 is pivotally mounted from a top end of a side wall 318 of the drain 310. As a result, the valve member 342 is pivotable between an open position (indicated by the solid line representation of the valve member 342 in FIG. 5), in which the valve member 342 is out of contact with a valve seat 326 formed around an opening (i.e., passageway) 316 of the drain 310, and a closed position (indicated by the broken line representation of the valve member 342 in FIG. 5), in which the valve member 342 is in contact with the valve seat 326. A torsion spring (not shown) is provided for urging the valve member 342 towards its closed position. Moreover, a pinion member 374 is connected to the valve member 342 for conjoint pivotal movement with same. For user safety purposes, the drain 310 is provided with a cover 330 having a rack member 336 which extends horizontally from the cover 330 and which includes a plurality of gear teeth 376 sized and shaped to mate with the pinion member 374.

Still referring to FIG. 5, to install the cover 330 to the drain 310, the cover 330 is applied to the drain 310 sideways (as indicated by the broken line representation of the cover 330 in FIG. 5). As the cover 330 is applied, the gear teeth 376 of the rack member 336 engage the pinion member 374, causing the valve member 342 to pivot towards its open position. When the cover 330 is properly aligned with the drain 310, a lip 378 of the cover 330 automatically snap-fits around the drain 310, securing the cover 330 to the drain 310. The cover 330 may be further secured to the drain 310 using screws (not shown). In the event that the cover 330 is accidentally or otherwise removed from the drain 310, the rack member 336 causes the valve member 342 to pivot towards its closed position, thereby obstructing the opening 316 and hence preventing water flow through the drain 310 during the operation of an associated pump. In addition, if the cover 330 is not properly installed to the drain 310 (e.g., the lip 378 of the cover 330 is not properly snap-fitted around the drain 310), the torsion spring forces the valve member 342 towards its closed position and thereby causes the cover 330 to pop off from the drain 310.

FIGS. 6A and 6B illustrate a drain 410 which is equipped with a safety device 434 constructed in accordance with a fifth embodiment of the present invention. The construction and operation of the safety device 434 are identical to those of the safety device 34 illustrated in FIGS. 1–2B, except as follows. The safety device 434 includes a double-tiered valve 438 removably or permanently mounted over an opening 416 formed in a drain body 414 of the drain 410. More particularly, the valve 438 has a lower member 438*a*, which is immovable with respect to the drain body 414, and an upper member 438*b* movably mounted on the lower member 438*a*. The lower member 438*a* includes a plurality of orifices 480 at a top end thereof, while the upper member 438*b* includes a skirt 482 at a bottom end thereof The upper member 438*b* is vertically movable relative to the lower member 438*a* between a lower (i.e., closed) position (indicated by the solid line representation of the upper member 438*b* in FIG. 6A) and an upper (i.e., open) position (indicated by the broken line representation of the upper member 438*b* in FIG. 6A). In the lower position, the skirt 482 of the upper member 438*b* is in alignment with the orifices 480 of the lower member 438*a*, preventing fluid communication between an associated swimming pool and the opening 416 and thereby inhibiting water flow through the drain 410 during the operation of an associated pump. In the upper position, the skirt 482 of the upper member 438*b* is out of alignment with the orifices 480, allowing fluid communication between the swimming pool and the opening 416 and thereby permitting water flow through the drain 410 during the operation of the pump. A spring 448 is mounted to the upper member 438*b* and to the lower member 438*a* or the drain body 414 so as to constantly pull the upper member 438*b* towards its lower (i.e., closed) position. Moreover, the valve 438 is provided with a pair of projections 484 mounted from the upper member 438 for conjoint movement with same (see FIG. 6B). The drain 410 is also provided with a drain cover 430 having a pair of cams 436 adapted to engage the projections 484 for purposes to be discussed hereinafter.

With reference to FIG. 6B, which is a top plan view of the drain 410 and the cover 430 during the installation of the cover 430 to the drain 410, as the cover 430 is applied to the drain 410 sideways (as indicated by the arrow B in FIGS. 6A and 6B), the cams 436 are inserted between the drain body 414 and the projections 484, thereby causing the projections 484 and hence the upper member 438*b* to move upwardly to the upper (i.e., open) position. When the cover 430 is properly installed, the upper member 438*b* is maintained in its upper position by the cams 436, thereby allowing water flow from the swimming pool to the opening 416 through the orifices 480. To secure the cover 430 to the drain 410, screws (not shown) are applied to the cover 430 and the drain 410. If, during the operation of the pump, the cover 430 is accidentally or otherwise removed from the drain 410, the cams 436 disengage the extensions 484, and, as a result, the spring 448 pulls the upper member 438*b* to its lower (i.e., closed) position, thereby causing the orifices 480 to be obstructed by the skirt 482 and hence inhibiting water flow through the drain 410.

Figure 7A:
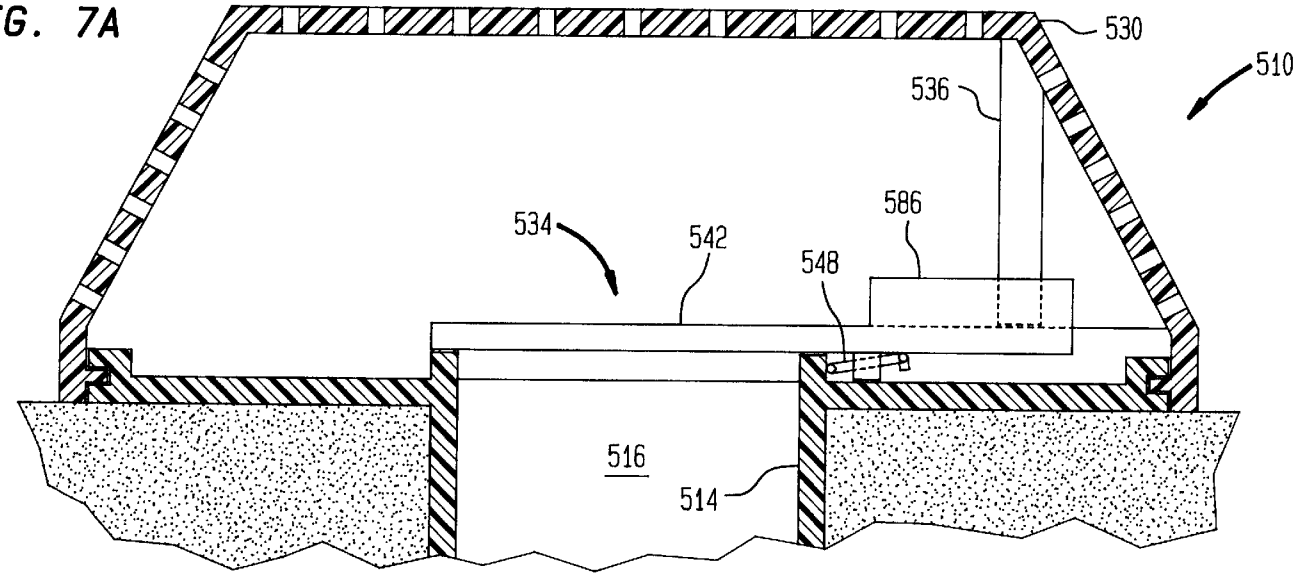
FIG. 7A is a cross-sectional side view of a drain equipped with a safety device constructed in accordance with a sixth embodiment of the present invention.
Figure 7B:
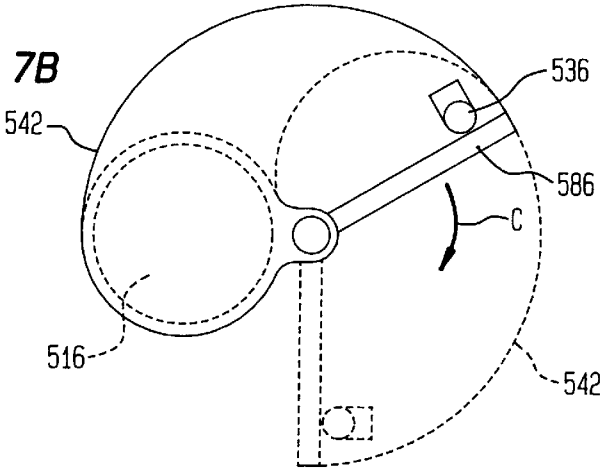
FIG. 7B is a top plan view of a valve employed by the drain illustrated in FIG. 7A, an associated drain cover having been removed to facilitate consideration and discussion.

FIGS. 7A and 7B illustrate a drain 510 which is equipped with a safety device 534 constructed in accordance with a sixth embodiment of the present invention. The construction and operation of the safety device 534 are identical to those of the safety device 34 illustrated in FIGS. 1–2B, except as follows. A valve member 542 is rotatably mounted on a drain body 514 of the drain 510. As a result, the valve member 542 is rotatable relative to the drain body 514 between a closed position (indicated by the solid line representation of the valve member 542 in FIG. 7B), in which the valve member 542 is in alignment with an opening 516 formed in the drain body 514, and an open position (indicated by the broken line representation of the valve member 542 in FIG. 7B), in which the valve member 542 is out of alignment with the opening 516. In addition, the valve member 542 has a cam wall 586 and a spring 548 for urging the valve member 542 towards its closed position. For user safety purposes, the drain 510 is provided with a cover 530 having a cam follower 536 which depends from the cover 530 and which is sized and shaped to engage the cam wall 586 of the valve member 542.

With reference to the FIG. 7B, to install the cover 530 to the drain 510, the cover 530 (not shown in FIG. 7B to facilitate consideration and discussion) is positioned on the drain body 514 and is then rotated relative to the drain body 514 (as indicated by the arrow C in FIG. 7B) until it is snap-fitted to the drain body 514 of the drain 510. As the cover 530 is applied to the drain 510, the cam follower 536 engages the cam wall 586 of the valve member 542 and causes the valve member 542 to rotate toward the open position. To further secure the cover 530 to the drain 510, screws (not shown) are applied to the cover 530 and the drain body 514. In the event that the cover 530 is accidentally or otherwise removed from the drain 510, the cam follower 536 disengages the cam wall 586, and, as a result, the spring 548 causes the valve member 542 to move into its closed position, thereby obstructing the opening 516 and hence preventing water flow through the drain 510.

It will be understood that the embodiments described herein are merely exemplary and that a person skilled in the art may make many variations and modifications without departing from the spirit and scope of the invention. For instance, while valves shown in FIGS. 1–7B are purely mechanical, the present invention can utilize pneumatic, hydraulic or electro-mechanical valves. If such valves are employed, optical sensors, vacuum or pressure devices or switches can be provided for cooperating with the cover so as to actuate the valves between an open position and a closed position. For example, an optical sensor can be used so that when a rib depending from the cover is in a predetermined relation with the optical sensor (i.e., when the cover is in a proper position relative to the drain), the sensor actuates the valve to its open position. When the cover is removed or is not in a proper position relative to the drain, the sensor actuates the valve to its closed position, thereby inhibiting water flow through the drain. Moreover, while the safety devices shown in FIGS. 1–7B are responsive to the removal of the associated drain covers, the safety device of the present invention can be designed to be responsive to the position or condition of the cover relative to the drain by using a sensor or switch positioned adjacent to the cover. All such variations and modifications are intended to be included within the scope of the invention as defined in the appended claims.

I claim:

1. A suction outlet assembly adapted for use in swimming pools, whirlpools and spas, comprising a body having an opening therein which is sized and shaped so as to be in communication with a pump adapted to create sufficient suction for causing fluid flow through said body; a cover mounted over said opening without substantially obstructing fluid flow through said body; and obstructing means for obstructing said opening when said cover is detached from affixed to said body, whereby fluid flow through said body is substantially prevented even if the pump is in operation.

2. The outlet assembly of claim 1, wherein said body is sized and shaped so as to be mounted in a main drain outlet for swimming pools, whirlpools and spas.

3. The outlet assembly of claim 1, wherein said obstructing means includes a valve movable between an open position, in which said valve permits fluid flow through said opening, and a closed position, in which said valve inhibits fluid flow through said opening.

4. The outlet assembly of claim 3, wherein said valve is in said open position when said cover is affixed to said body; and wherein said valve is in said closed position when said cover is detached from said body.

5. The outlet assembly of claim 4, wherein said obstructing means includes positioning means for positioning said valve in said open position when said cover is affixed to said body.

6. The outlet assembly of claim 5, wherein said obstructing means includes urging means for urging said valve towards said closed position.

7. The outlet assembly of claim 6, wherein said positioning means includes a positioning member which is sized and shaped to engage said valve for positioning said valve in said open position when said cover is affixed to said body and to disengage said valve to cause said valve to move to said closed position when said cover is detached from said body.

8. The outlet assembly of claim 7, wherein said positioning member is positioned between said cover and said valve when said cover is affixed to said body.

9. The outlet assembly of claim 8, wherein said positioning member has a head and a leg depending from said head.

10. The outlet assembly of claim 9, wherein said head has a plurality of holes so as not to obstruct fluid flow through said body.

11. The outlet assembly of claim 10, wherein said leg of said positioning member has an end sized and shaped so as to engage said valve for moving said valve to said open position when said cover is affixed to said body.

12. The outlet assembly of claim 11, wherein said valve has an arm sized and shaped so as to engage said end of said leg.

13. The outlet assembly of claim 12, wherein said end of said leg has a track sized and shaped so as to slidably engage said arm for pivoting said valve to said open position when said cover is affixed to said body.

14. The outlet assembly of claim 12, wherein said end of said leg is rotatably secured to said arm of said valve.

15. The outlet assembly of claim 8, wherein said urging means includes a spring mounted on said valve.

16. The outlet assembly of claim 15, wherein said spring is sized and shaped so as to urge said positioning member against said cover and to thereby cause the detachment of said cover from said body in the event that said cover is not affixed to said body.

17. The outlet assembly of claim 6, wherein said valve includes a lower member, which is sized and shaped so as to be immovably mounted on said body over said opening, and an upper member movably mounted on said lower member so as to move between an upper position, in which said upper member cooperates with said lower member to permit fluid flow through said valve and hence through said body, and a lower position, in which said upper member cooperates with said lower member to inhibit fluid flow through said valve and hence through said body.

18. The outlet assembly of claim 17, wherein said urging means includes a spring mounted to said upper member and to one of said lower member and said body for pulling said upper member towards said lower position.

19. The outlet assembly of claim 18, wherein said positioning means includes a cam extending from said cover and sized and shaped so as to engage said upper member and to position same in said upper position when said cover is affixed to said body.

20. The outlet assembly of claim 6, wherein said valve is sized and shaped so as to be pivotally mounted from said body adjacent an inlet of said body.

21. The outlet assembly of claim 20, wherein said positioning means includes a pinion, which is mounted on said valve, and a rack extending from said cover and having a plurality of teeth which are sized and shaped so as to mate with said pinion and to pivot said valve to said open position as said cover is applied to said body.

22. The outlet assembly of claim 20, wherein said positioning means includes an extension depending from said cover and sized and shaped so as to engage said valve and to pivot said valve to said open position as said cover is applied to said body.

23. The outlet assembly of claim 6, wherein said valve is sized and shaped so as to be rotatably mounted on said body.

24. The outlet assembly of claim 23, wherein said positioning means includes a projection, which extends from said valve, and a cam depending from said cover and sized and shaped so as to engage said projection for rotating said valve to said open position as said cover is applied to said body.

25. The outlet assembly of claim 3, wherein said valve has a valve member sized and shaped so as to be pivotally mounted in said opening of said body.

26. The outlet assembly of claim 25, wherein said valve has a base, which is sized and shaped so as to be removably mounted on a bottom wall of said opening, said valve member being pivotally mounted from said base.

27. The outlet assembly of claim 26, wherein said valve member is sized and shaped so as to engage a valve seat formed around an outlet of said body and to thereby obstruct said opening when said cover is detached from said body.

28. A safety device for use in a suction outlet assembly for swimming pools, whirlpools and spas, the outlet assembly having an opening therein in communication with a pump adapted to create sufficient suction for causing fluid flow through the outlet assembly and a cover mounted over the opening without substantially obstructing fluid flow therethrough, said safety device comprising obstructing means for obstructing the opening when the cover is detached from the outlet assembly, whereby fluid flow through the outlet assembly is substantially prevented even if the pump is in operation, said obstructing means including a valve movable between an open position, in which said valve permits fluid flow through the opening when the cover is affixed to the outlet assembly, and a closed position, in which said valve inhibits fluid flow through the opening when the cover is detached from the outlet assembly, positioning means for positioning said valve in said open position when the cover is affixed to the outlet assembly, and urging means for urging said valve towards said closed position, said positioning means including a positioning member which is sized and shaped to engage said valve for positioning said valve in said open position when the cover is affixed to the outlet assembly and to disengage said valve for causing said valve to move to said closed position when the cover is detached from the outlet assembly, and said valve having a valve member sized and shaped so as to be pivotally mounted in the opening of the outlet assembly.

29. The safety device of claim 28, wherein said valve has a base, which is sized and shaped so as to be removably mounted on a bottom wall of the opening, said valve member being pivotally mounted from said base.

30. The safety device of claim 29, wherein said valve member is sized and shaped so as to engage a valve seat formed around an outlet of the outlet assembly and to thereby obstruct the opening when the cover is detached from the outlet assembly.

31. A safety device for use in a suction outlet assembly for swimming pools, whirlpools and spas, the outlet assembly having an opening therein in communication with a pump adapted to create sufficient suction for causing fluid flow through the outlet assembly and a cover mounted over the opening without substantially obstructing fluid flow therethrough, said safety device comprising obstructing means for obstructing the opening when the cover is detached from the outlet assembly, whereby fluid flow through the outlet assembly is substantially prevented even if the pump is in operation, said obstructing means including a valve movable between an open position, in which said valve permits fluid flow through the opening when the cover is affixed to the outlet assembly, and a closed position, in which said valve inhibits fluid flow through the opening when the cover is detached from the outlet assembly, positioning means for positioning said valve in said open position when the cover is affixed to the outlet assembly, and urging means for urging said valve towards said closed position, said positioning means including a positioning member which is sized and shaped to engage said valve for positioning said valve in said open position when the cover is affixed to the outlet assembly and to disengage said valve for causing said valve to move to said closed position when the cover is detached from the outlet assembly, said positioning member being sized and shaped so as to be positioned between the cover and said valve when the cover is affixed to the outlet assembly, and said positioning member having a head and a leg which depends from said head and which has a plurality of holes so as not to obstruct fluid flow through the outlet assembly.

32. The safety device of claim 31, wherein said leg of said positioning member has an end sized and shaped so as to engage said valve for moving said valve to said open position when the cover is affixed to the outlet assembly.

33. The safety device of claim 32, wherein said valve has an arm sized and shaped so as to engage said end of said leg.

34. The safety device of claim 33, wherein said end of said leg has a track sized and shaped so as to slidably engage said arm for pivoting said valve to said open position when the cover is affixed to the outlet assembly.

* * * * *